United States Patent [19]

Keidar et al.

[11] Patent Number: 4,919,427

[45] Date of Patent: Apr. 24, 1990

[54] MOEBIUS RING PUZZLE

[76] Inventors: Itzhak Keidar, 19 Chisin Street; Asher Dromi, 11 Shderot Yotzer, both of Tel Aviv; Menahem Tilman, 34 Shaldag Street, Hofit, all of Israel

[21] Appl. No.: 332,141

[22] Filed: Apr. 3, 1989

[51] Int. Cl.[5] ..... A63F 9/08

[52] U.S. Cl. ..... 273/155

[58] Field of Search ..... 273/155, 157 A

[56] References Cited

U.S. PATENT DOCUMENTS 2,038,022 4/1936 Zubli ..... 273/157 A X
4,384,717 5/1983 Morris ..... 273/156

FOREIGN PATENT DOCUMENTS 3439509 4/1986 Fed. Rep. of Germany ..... 273/155
1309165 10/1962 France ..... 273/157 A

*Primary Examiner*—Anton O. Oechsle
*Attorney, Agent, or Firm*—Benjamin J. Barish

[57] ABSTRACT

A puzzle comprises a strip of flexible sheet material formed into a closed loop having twists to define two (or more) Moebius rings manually juxtapositionable with respect to each other. The strip is transparent and includes opaque markings which are viewable through the two rings of the transparent strip to define a predetermined pattern, representing a correct solution of the puzzle, only when the two Moebius rings are located in a predetermined juxtaposition with respect to each other.

6 Claims, 2 Drawing Sheets

FIG 1a
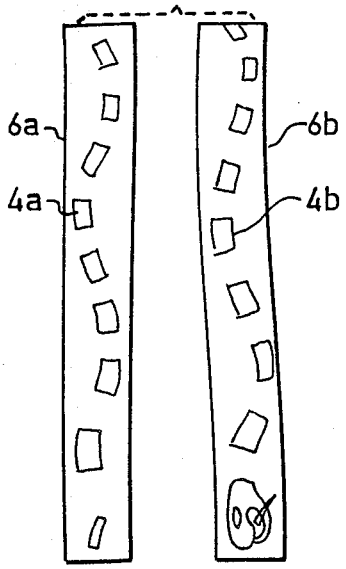
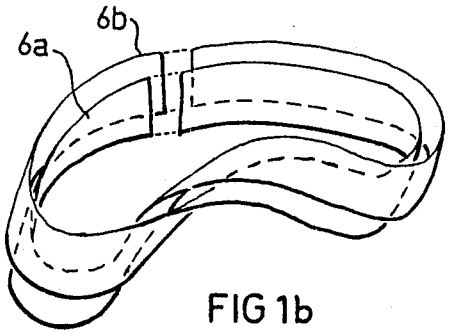
FIG 1b
FIG 1c
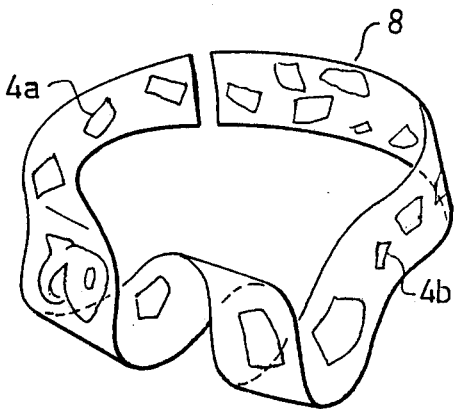
FIG 2
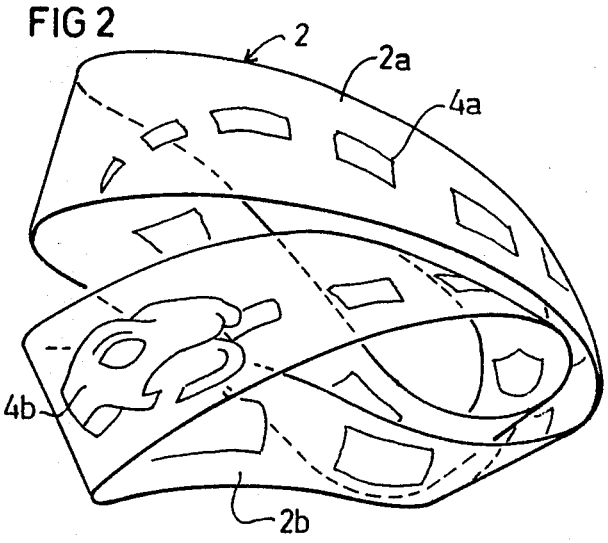

MOEBIUS RING PUZZLE

BACKGROUND OF THE INVENTION

The present invention relates to puzzles, and particularly to a puzzle based on the Moebius strip or ring.

A Moebius ring or strip, named after Augustus Ferdinand Moebius (1790–1868) who used it to demonstrate certain characteristics, can be made by taking a strip of flexible sheet material, giving it a 180° twist, and then joining its opposite ends. Its characteristic of particular interest is that both of its faces are constituted of only one continuous side which includes only one continuous edge.

An object of the present invention is to provide a puzzle based on the Moebius strip or ring.

BRIEF SUMMARY OF THE INVENTION

According to the invention, there is provided a puzzle comprising a strip of flexible sheet material formed into a closed loop having twists to define at least two Moebius rings manually juxtapositionable with respect to each other; that is, the flexible strip may be manipulated to many different positions of one ring overlying the other. The strip includes markings which define a predetermined pattern, representing a correct solution of the puzzle, only when the two Moebius rings are located in a predetermined juxtaposition with respect to each other.

Preferably, the strip is transparent, and the markings are opaque, or transparent of another colour, to permit viewing the markings when the two Moebius rings are manually juxtapositioned with respect to each other.

One way of forming the closed loop of two rings is to provide two strips of equal lengths and widths, apply a 180° twist to them, and then join their opposite ends. A second way of forming the closed loop is to use a single strip but to apply four 180° twists, and then join the opposite ends of the strip.

The puzzle may be constructed for increased complexity in its solution by including more than two Moebius rings.

Thus, the puzzle may include a third Moebius ring formed as a closed loop in a separate strip and linking the first-mentioned strip such as to permit all three rings to be manually juxtapositioned with respect to each other. The separate strip also includes markings which cooperate with the markings on the first-mentioned strip to define a predetermined pattern, representing a correct solution of the puzzle, only when the three Moebius rings are located in a predetermined juxtaposition with respect to each other.

Such a puzzle construction may be provided by including three strips of equal lengths and widths laid one over the other, applying a 180° twist to all three, and then joining the three strips at their opposite ends. Thus, after applying the 180° twist, the ends of the two outer strips would be joined to each other to form one closed loop, and the ends of the single intermediate strip would be being joined to each other to form a second closed loop linked with the first closed loop. In such a construction, one loop, defined by the two outer strips, is formed with two Moebius rings; and the other loop, defined by the intermediate strip, is formed with a single Moebius ring and is linked with the loop having the two Moebius rings.

The puzzle may include a fourth Moebius ring formed in the separate strip together with the third Moebius ring such as to permit all four Moebius rings to be manually juxtapositioned with respect to each other. In such a construction, the two strips form interlinking loops each having two Moebius rings. The latter strip would also include markings which cooperate with the markings of the first-mentioned strip to define a predetermined pattern, representing a solution to the puzzle, only when all four Moebius rings are located in a predetermined juxtaposition with respect to each other.

It will be appreciated that puzzles of almost any complexity can be provided by producing any desired number of Moebius rings in this manner and applying to them markings which define a predetermined pattern, representing a correct solution of the puzzle, only when all the rings are located in a predetermined juxtaposition with respect to each other.

Further features and advantages of the invention will be apparent from the description below.

BRIEF DESCRIPTION OF THE DRAWINGS

The invention is herein described, by way of example only, with reference to the accompanying drawings, wherein:

FIGS. 1*a*, 1*b* and 1*c* illustrate two manners of forming a puzzle in accordance with the present invention including two Moebius rings;

FIG. 2 illustrates the puzzle formed as described with respect to FIGS. 1*a*–1*c*, but having markings which define a predetermined pattern, representing a correct solution of the puzzle, only when the two Moebius rings are located in a predetermined juxtaposition with respect to each other;

DESCRIPTION OF PREFERRED EMBODIMENTS

Figure 3:
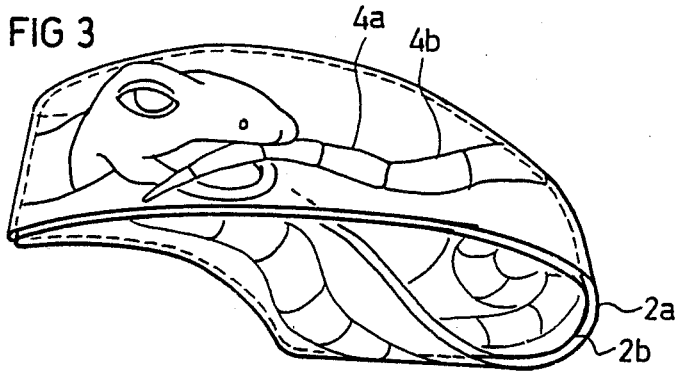
FIG. 3 illustrates the puzzle of FIG. 2 in the condition representing a correct solution of the puzzle.

FIGS. 2 and 3 illustrate a puzzle, generally designated 2, constituted of a strip of flexible sheet material formed into a closed loop and having twists defining two Moebius rings 2*a*, 2*b*. The strip is of transparent plastic having opaque markings 4*a*, 4*b* arranged such that when the two Moebius rings are located in a predetermined juxtaposition with respect to each other, i.e., one ring (e.g., 2*a*, FIG. 3) overlying the other ring (2*b*), the opaque markings (4*b*) of the underlying Moebius ring (2*b*), are viewable through the transparent portions of the overlying Moebius ring (2*a*) and are combinable with the markings (4*a*) of the overlying ring so as to produce a predetermined pattern, representing a correct solution of the puzzle. The correct pattern for this particular illustration is shown in FIG. 3, wherein it will be seen that the markings 4*a*, 4*b* of the two Moebius rings 2*a*, 2*b* produce the illustration of a snake biting its own tail.

One method of producing the two-ring puzzle of FIGS. 2 and 3 is illustrated in FIGS. 1*a* and 1*b*, and a second method is illustrated in FIG. 1*c*.

In the method of FIGS. 1*a* and 1*b*, two strips of flexible sheet material 6*a*, 6*b* are prepared with equal lengths and widths. Each of the strips is made of transparent plastic material and has opaque markings 4*a*, 4*b*, constituting fragments of the complete pattern to be produced in a correct solution of the puzzle. The two strips 6a, 6b are held one on top of the other, and then the ends of the two strips are given a half-turn, i.e., a 180° twist. The twisted end of each strip is then joined to the opposite end of the other strip, to form the two Moebius rings 2a, 2b.

The strip is manipulated such that the two Moebius rings are juxtapositioned, that is placed one over the other, whereby the markings (e.g., 4b) of the underlying ring (e.g., 2b), viewable through the transparent portions of the overlying ring (e.g., 2a), are combinable with the markings e.g., 4a) of the overlying ring. The aim of the puzzle is to manipulate the strip such that the two rings when juxtapositioned in a particular relation to each other, the markings of the two rings combine to produce a predetermined pattern, in this case a snake biting its tail as illustrated in FIG. 3.

The method illustrated in FIG. 1c, for producing the puzzle containing the Moebius rings 2a, 2b, uses a single strip of flexible, transparent sheet material 8 having the opaque markings 4a, 4b formed thereon. One end of the strip 8 is twisted four half-turns, i.e., 720° (four times 180°), and then the opposite ends are joined together. This will also produce the continuous loop illustrated in FIG. 2 formable into two Moebius rings with their markings 4a, 4b defining the predetermined pattern, representing a correct solution of the puzzle, only when the two Moebius rings are located in a predetermined juxtaposition with respect to each other, as illustrated in FIG. 3.

Figure 4:
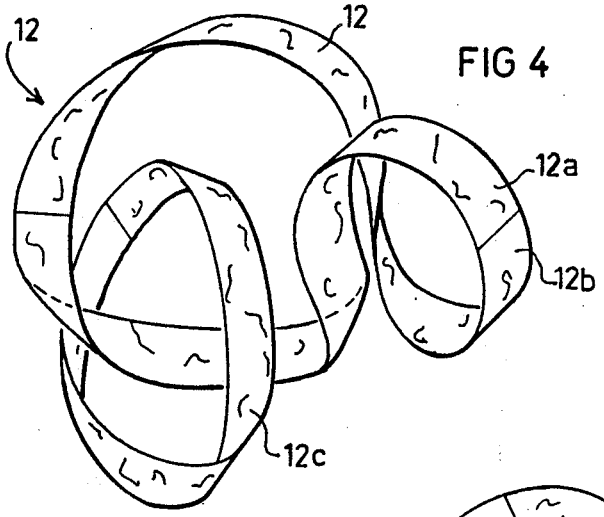
FIG. 4 illustrates a puzzle including three Moebius rings.

FIG. 4 illustrates a puzzle, generally designated 12, including three Moebius rings 12a, 12b, 12c, each having markings which, when the three Moebius rings are properly located in predetermined juxtapositions with respect to each other, define a predetermined pattern representing a correct solution of the puzzle. In the arrangement illustrated in FIG. 4, the puzzle consists of a first closed loop including two Moebius rings, 12a, 12b, and a second closed loop containing only a single Moebius ring 12c. The second closed loop is linked with the first closed loop and is one-half its length.

A preferred method of making the three-ring loop illustrated in FIG. 4 is to take three strips of flexible, transparent sheet material of equal lengths and widths laid one over the other, apply a 180° twist to one end of the three strips, and then join the opposite ends of the two outer strips to each other, and the opposite ends of the intermediate strip to each other. In such a case, the two outer strips form the larger loop with the two Moebius rings 12a, 12b in the same manner as described above with respect to FIGS. 1a and 1b; whereas the intermediate strip forms the smaller loop defining the single Moebius ring 12c, which intermediate strip links with the larger strip of the two Moebius rings 12a and 12b.

Figure 5:
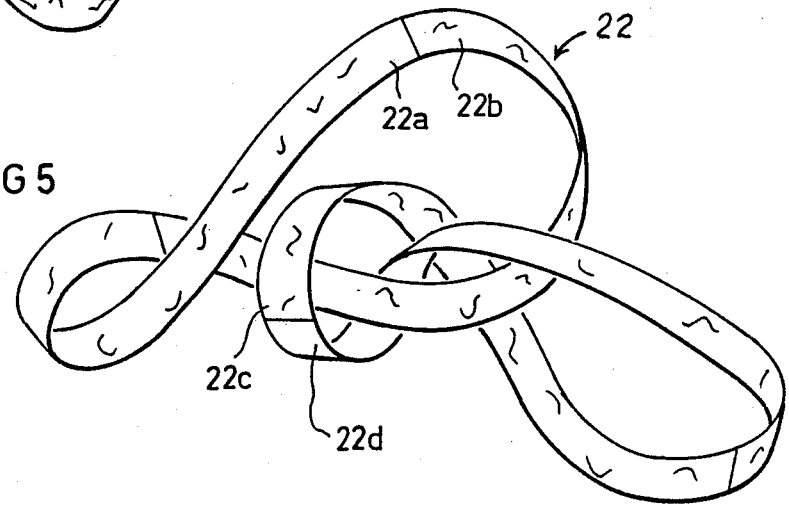
FIG. 5 illustrates a puzzle including four Moebius rings.

FIG. 5 illustrates a puzzle, generally designated 22, having four Moebius rings 22a, 22b, 22c, 22d. This may be produced by taking four strips of flexible, transparent sheet material of equal length and width, twisting one end of the four strips 180°, and then securing those ends with the opposite ends of the four strips. Thus, the end of one outer strip is secured to the opposite end of the other outer strip; and one end of one inner strip is secured to the opposite end of the other intermediate strip. In this manner, there are produced two loops, each including two Moebius rings 22a, 22b and 22c, 22d. One loop links the other loop so that the four Moebius rings may be juxtapositioned with respect to each other in order to produce, from their markings as described above, a predetermined pattern representing a correct solution of the puzzle.

A puzzle including four such Moebius rings is quite complicated to solve, but if it is desired to make the puzzle even more complicated, the puzzle could include additional Moebius rings by merely providing the appropriate number of strips to be twisted and joined at their opposite ends. If an even number of Moebius rings are to be formed, a plurality of interlinking loops would be formed wherein each of the loops defines two Moebius rings; and if an odd number of Moebius rings are to be formed, the interlinking loops would include one of the smaller loops containing but a single Moebius ring.

It will thus be seen that the invention provides a puzzle which can be designed for almost any degree of complexity desired. In the described preferred embodiment, the markings, which define the predetermined pattern representing a correct solution of the puzzle when the plurality of rings are all located in proper juxtapositions with respect to each other, are shown as opaque markings on a transparent background. It will be appreciated, however, that the markings could also be opaque but of a different colour so as to be discernible from the remainder of the transparent sheet. It will also be appreciated that instead of using transparent strips, there may also be used opaque strips wherein the markings are in the form of holes which align with other markings, e.g., dots, when all the Moebius rings are located in the proper juxtaposition with respect to each other.

Many other variations, modifications and applications of the invention will be apparent.

What is claimed is:

1. A puzzle comprising a strip of flexible sheet material formed into a closed loop having twists to define at least two Moebius rings manually juxtapositionable with respect to each other; said strip being transparent and including opaque markings which are viewable through the transparent strips to define a predetermined pattern, representing a correct solution of the puzzle, only when said two Moebius rings are located in a predetermined juxtaposition with respect to each other.

2. The puzzle according to claim 1, wherein said closed loop is constituted of two strips of equal lengths and widths both having a 180° twist and then joined at their opposite ends.

3. The puzzle according to claim 1, wherein said closed loop is constituted of a single strip having four 180° twists and then joined at its opposite ends.

4. The puzzle according to claim 1, including a third Moebius ring formed as a closed loop in a separate strip and linking said first-mentioned strip such as to permit all three rings to be manually juxtapositioned with respect to each other; said separate strip also including markings which cooperate with the markings on the first-mentioned strip to define a predetermined pattern, representing a correct solution of the puzzle, only when said three Moebius rings are located in a predetermined juxtaposition with respect to each other.

5. The puzzle according to claim 4, wherein said three Moebius rings are constituted of three strips of equal lengths and widths laid one over the other and all having a 180° twist, the opposite ends of one of the outer one of said strips being joined to the opposite ends of the other outer one of said strips to form a first closed loop, the opposite ends of the intermediate strip being joined together to form a second closed loop evoked with the first closed loop.

6. The puzzle according to claim 4, wherein a fourth Moebius ring is formed in said separate strip together with the third Moebius ring such as to permit all four Moebius rings to be manually juxtapositioned with respect to each other; said separate strip also including markings which cooperate with the markings of the first-mentioned strip to define a predetermined pattern, representing a solution to the puzzle, only when all four Moebius rings are located in a predetermined juxtaposition with respect to each other.

* * * * *